US005880662A

United States Patent [19]

Person et al.

[11] Patent Number: 5,880,662

[45] Date of Patent: Mar. 9, 1999

[54] HIGH SELF RESONANT FREQUENCY MULTILAYER INDUCTOR AND METHOD FOR MAKING SAME

[75] Inventors: Herman R. Person; Jeffrey T. Adelman; Thomas L. Veik, all of Columbus, Nebr.

[73] Assignee: Dale Electronics, Inc., Columbus, Nebr.

[21] Appl. No.: 915,875

[22] Filed: Aug. 21, 1997

[51] Int. Cl.[6] ..... H01F 5/00; H01F 27/29

[52] U.S. Cl. ..... 336/200; 336/223; 336/192; 336/219

[58] Field of Search ..... 336/200, 223, 336/234, 192, 219

[56] References Cited

U.S. PATENT DOCUMENTS 5,032,815 7/1991 Kobayashi et al. ..... 336/83
5,126,707 6/1992 Ikeda ..... 336/200
5,302,932 4/1994 Peson et al. ..... 336/200

*Primary Examiner*—Lincoln Donovan
*Assistant Examiner*—Anh Mai
*Attorney, Agent, or Firm*—Zarley, McKee, Thomte, Voorhees & Sease

[57] ABSTRACT

A high self resonant frequency inductor and method for making the same is described. The inductor comprises a plurality of horizontal conductor coils vertically spaced apart, including a top conductor coil and a bottom conductor coil, the top and bottom conductor coils each having a conductive termination. Dielectric material extends between and separates the conductive coils and the top and bottom terminations. The dielectric material has a plurality of via holes therein to provide communication between adjacent pairs of the conductive coils, the top conductive coil and top termination, and the bottom conductive coil and bottom termination. A plurality of conductive via connections extend through the via holes to connect the plurality of conductor coils, the top termination, and the bottom termination in series with one another.

7 Claims, 7 Drawing Sheets

HIGH SELF RESONANT FREQUENCY MULTILAYER INDUCTOR AND METHOD FOR MAKING SAME

BACKGROUND OF THE INVENTION

The present invention relates to a high self resonant frequency multilayer inductor and method for making same.

All inductors have a self resonant frequency. The self resonant frequency is determined by an inverse relationship between the inductance of the coil and the residual capacitance of the inductance coil. As the residual capacitance increases, the self resonant frequency decreases. It is important to have a self resonant frequency as high as possible because this allows the inductor to operate at a higher frequency. Consequently, in order to maximize the self resonant frequency, it is desirable to reduce the residual capacitance within the inductor.

FIGS. 2 and 4 show a typical prior art inductor 10. Inductor 10 includes two end terminations 12, 14 which are secured over the opposite ends of a coil assembly 16. Referring to FIG. 4, the coil assembly 16 includes a top coil layer 18, a plurality of intermediate coil layers 20, and a bottom coil layer 22. The coil layers 18, 20, and 22 are vertically spaced apart from one another and a dielectric 24 fills the spaces between the various layers 18, 20, 22. Via openings 26 in the dielectric are filled with conductive via fills 28 which connect the various coil layers 18, 20, 22 in series with one another to form a multi turn inductance coil.

The top coil layer 18 is in electrical contact with end termination 14 by means of a top coil layer connection 30. The bottom coil layer 22 is in electrical contact with the end termination 12 at the bottom coil layer connection 32.

There are two kinds of capacitance which are inherent in the arrangement shown in FIG. 4. Between each coil layer 18, 20, 22 there is a capacitance designated by the numeral 34. The capacitances between each of the layers are in series with one another.

In addition to the series capacitances 34 there are a plurality of parallel capacitances designated by the numeral 36 between the outer most edges of each coil layer 18, 20, 22 and the terminations 12, 14.

Therefore, a primary object of the present invention is the provision of an improved high self resonant frequency multilayer inductor and method for making same.

A further object of the present invention is the provision of an improved inductor and method for making same which results in an increase in the self resonant frequency over prior art inductor designs.

A further object of the present invention is the provision of an improved inductor and method for making same which reduces the capacitance between the coil layers of the inductor and the terminations.

A further object of the present invention is the provision of an improved inductor and method for making same which results in a more reliable method of making contact between the ends of the inductor coil and the terminations.

A further object of the present invention is the provision of an improved inductor and method for making same which optionally eliminates the dipping process for creating solder terminations as done previously in prior art devices.

A further object of the present invention is the provision of an improved inductor and method for making same which results in the ability to make smaller parts.

A further object of the present invention is the provision of an improved inductor and method for making same which optionally eliminates the need for grinding or buffing rough edges at the sides of the inductor as was necessary in the manufacture of prior art inductor designs.

A further object of the present invention is the provision of an improved inductor and method for making same which decreases the labor costs, increases the manufacturing yield, and increases the reliability of the part.

A further object of the present invention is the provision of an inductor and method for making same which is efficient, durable, and simple to manufacture.

SUMMARY OF THE INVENTION

The foregoing objects may be achieved by a multilayer inductor comprised of a plurality of conductor coils stacked above one another. Each of the conductor coils lies substantially in a horizontal plane and is vertically spaced apart from the other of the conductor coils. One of the conductor coils is a top conductor coil positioned above all of the other conductor coils, and another of the conductor coils is a bottom conductor coil positioned below all of the other conductor coils.

The inductor includes a top conductive termination all of which is vertically spaced above all of the conductor coils, and a bottom conductive termination, all of which is spaced below all of the conductor coils. A dielectric material extends between and separates the vertically spaced apart conductor coils and the top and bottom terminations. The dielectric material has a plurality of via holes therein which provide communication between adjacent pairs of the conductive coils, between the top conductive coil and the top termination, and between the bottom conductive coil and the bottom termination. A plurality of conductive via connections extend through the via holes to connect the plurality of conductor coils, the top termination, and the bottom termination in series with one another.

While the above description utilizes the terms top, bottom, above, and below, these terms are used only for purposes of orientation. The two terminations may be placed at opposite sides of the inductor, with the various coil layers being horizontally spaced with respect to one another. This is the preferred embodiment of the present invention.

The method of the present invention includes forming an inductor coil comprising a first coil end and a second coil end, a plurality of conductor coil layers electrically connected in series with one another between the first and second coil ends, and a plurality of dielectric layers alternatively interposed between the conductive coil layers. A first dielectric layer is formed over the first coil end, the first dielectric layer having a first via hole positioned in registered alignment over the first coil end. The first via hole is filled with an electrically conductive material to form a first via fill in electrical connection with the first coil end.

An electrically conductive first termination is formed over the first dielectric layer in electrical contact with the first via fill so as to electrically connect the first termination to the first coil end.

A second dielectric layer is formed over the second coil end, the second dielectric layer includes a second via hole positioned in registered alignment over the second coil end. The second via hole is filled with an electrically conductive material to form a second via fill in electrical connection with said second coil end.

DETAILED DESCRIPTION OF THE PREFERRED EMBODIMENT

Figure 1:
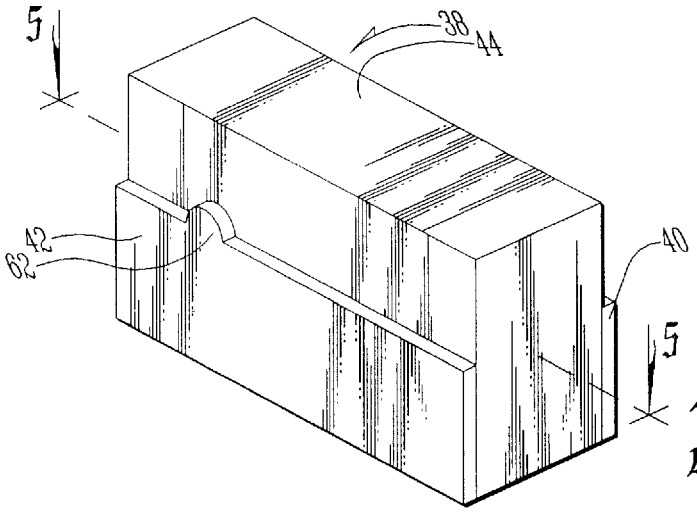
FIG. 1 is a perspective view of the inductor of the present invention.
Figure 2:
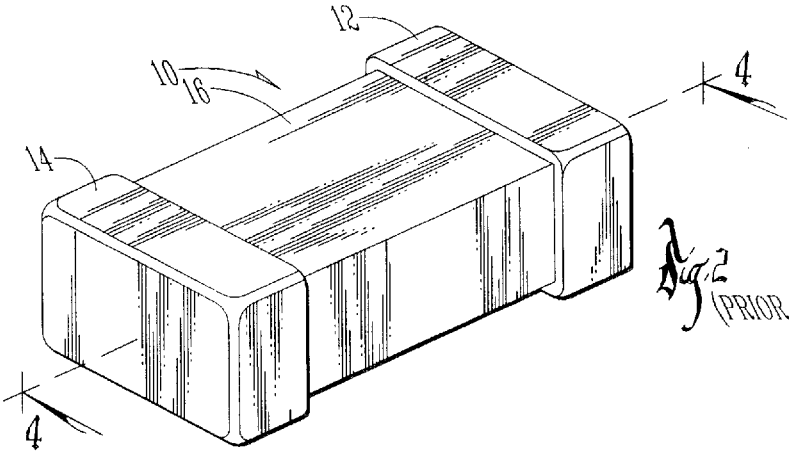
Fig. 2 (PRIOR ART)
FIG. 2 is a perspective view of a typical prior art inductance coil.

Referring now to FIG. 1, the numeral 38 designates the inductor of the present invention. Inductor 38 includes a first termination 40 at one side thereof and a second termination 42 at the other side thereof. Extending therebetween is a coil assembly 44.

Figure 3:
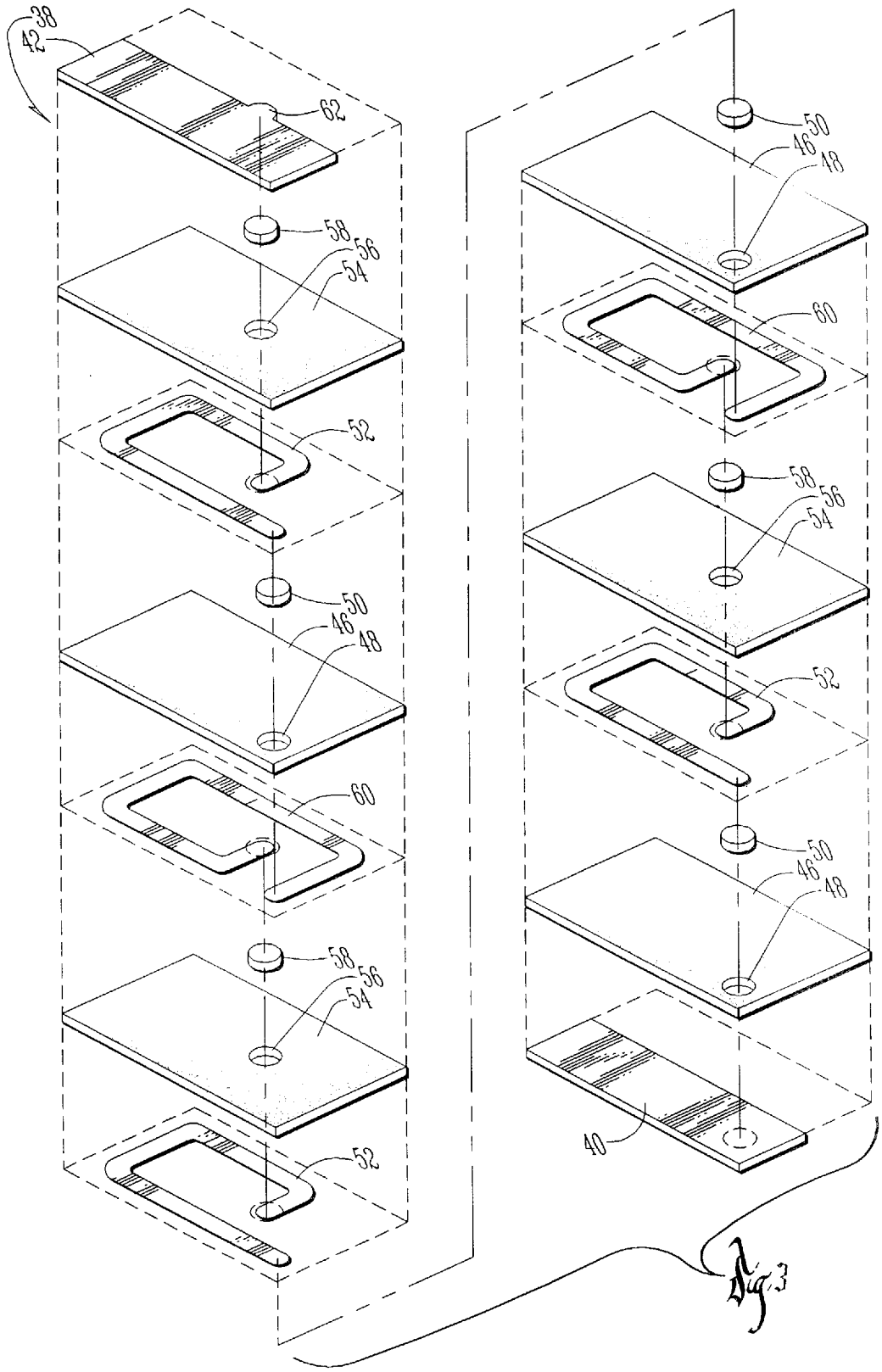
FIG. 3 an exploded view of the inductance coil of FIG. 1.

Referring to FIG. 3, the coil assembly 44, the inductor 38 comprises a bottom dielectric layer 46 which is printed over the bottom termination 40. Dielectric layer 46 includes a bottom via hole 48 which is filled by a bottom via fill 50 made of electrically conductive material. Via fill 50 is in electrical contact with second termination 40 and is also in electrical connection with a first conductive coil layer 52 printed on the upper surface of bottom dielectric 46.

Printed over bottom dielectric layer 46 and first coil layer 52 is a second dielectric layer 54 having a second via opening 56 registered over one end of the conductive coil layer 52. A second via fill 58 is within the via hole 56 and provides electrical connection between the first coil layer 52 and a second coil layer 60 which is printed on the upper surface of the second dielectric layer 54. The dielectric layers 46, 54 are repeated alternatively for as many times as desired in order to achieve the number of coil turns desired for the inductor. FIG. 3 shows five separate coil layers and six separate dielectric layers. Printed over the upper most dielectric layer 46 and the upper most conductive coil 52 is the upper most dielectric layer 54 having a via hole 56 therein housing a via fill 58. Printed over the upper most dielectric layer 54 is the second terminal 42 which has a tab 62 registered with the via opening 56. Thus the via fill 58 provides electrical connection between the upper most conductive coil layer 52 and the second termination 42.

Figure 6:
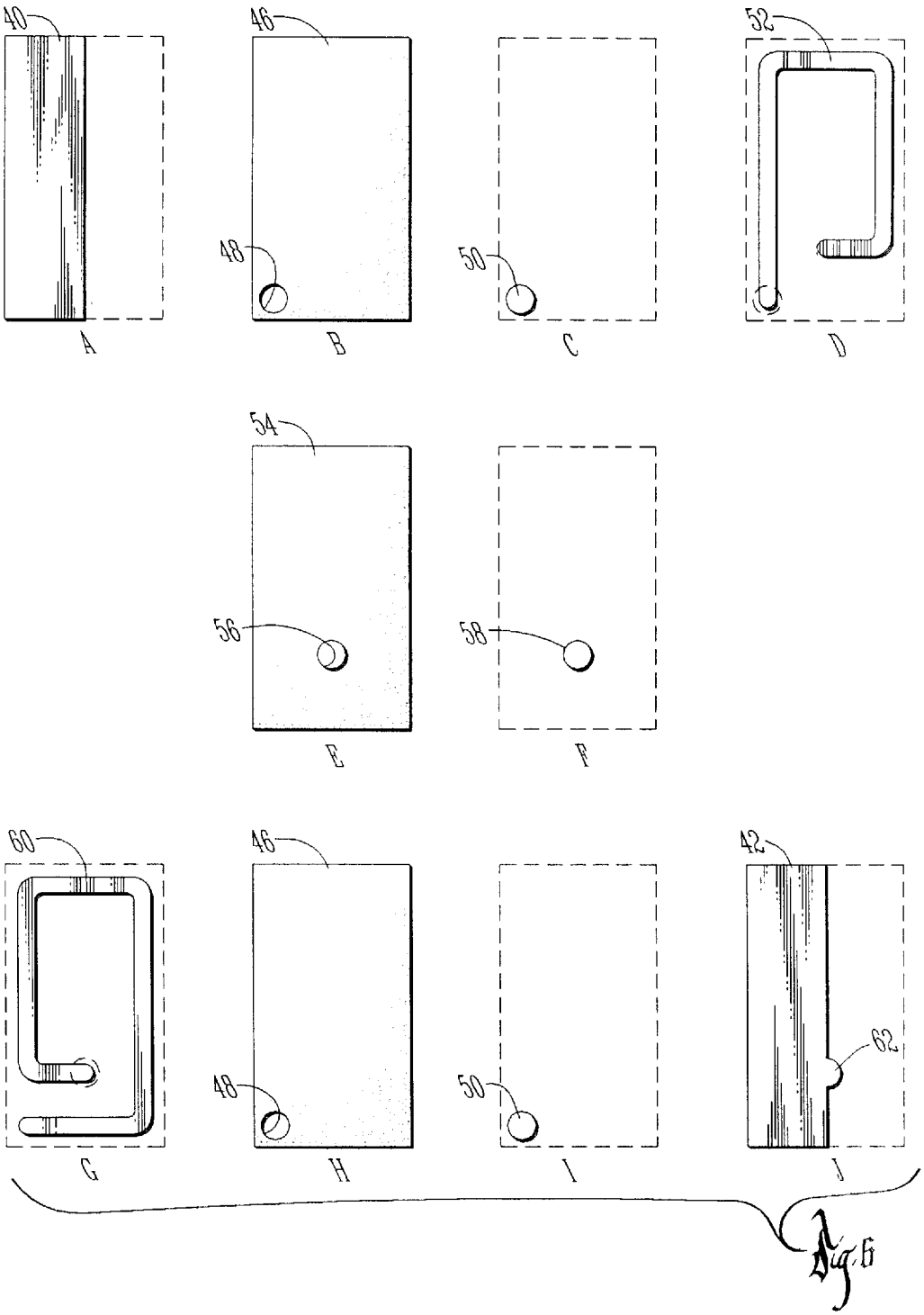
FIG. 6 is a top plan view showing the various printing steps and layers for printing the inductor of the present invention.

FIG. 6 illustrates the various printing patterns that are used to print the layers shown in FIG. 3.

The printing operation is conducted upon a substrate having a layer of an appropriate alternative "buffer" ("consumable buffer") covering the upper surface thereof. The buffer is of sufficient thickness that it can be peeled off of the substrate after the printing operation has been complete. The substrate is large enough to permit a plurality of inductor assemblies to be printed at one time in a matrix relationship on the buffer layer.

The initial printing step is shown at A, and includes the printing of the first termination 40 as shown at A. Next, the first dielectric layer 46 is printed over the first termination 40. The next printing step is shown at C and involves printing the via fill 50 in the via opening 48. At D the first conductive coil layer 52 is printed over the dielectric layer 46 in contact with the via fill 50.

At E is shown the second dielectric layer 54 having the via opening 56 therein. F shows the printing pattern for the via fill 58, and G shows the printing pattern for the second coil conductor 60 which is printed over the dielectric layer 54 in registered alignment with the via fill 58. H and I show a repeat of the dielectric layer 46 and of the via fill 50. The dielectric layers 46, 54 can be alternatively repeated as many times as desired. In the embodiment shown in FIG. 3 the upper most layer is shown to be dielectric layer 54, but it is possible to have the upper most layer be a pattern 46 as well. In either case, the top termination 42 is printed over the upper most dielectric layer and is in electrical contact by means of the via fill 50, or 58, with the conductive coil located there below.

With the preferred embodiment, it is not necessary to dip the inductors for providing the terminations, since the terminations are already in place. Because the termination does not extend around the edge of the part in the preferred embodiment, there is no requirement for tumbling of the parts after assembly as was required with the prior art devices. The tumbling was necessary with prior devices because the termination wrapped around the edge of the inductor and would become very thin if the edge was not rounded. However, note that with the alternative embodiment shown in FIG. 9 and described below, the tumbling and dipping steps may be used.

Figure 4:
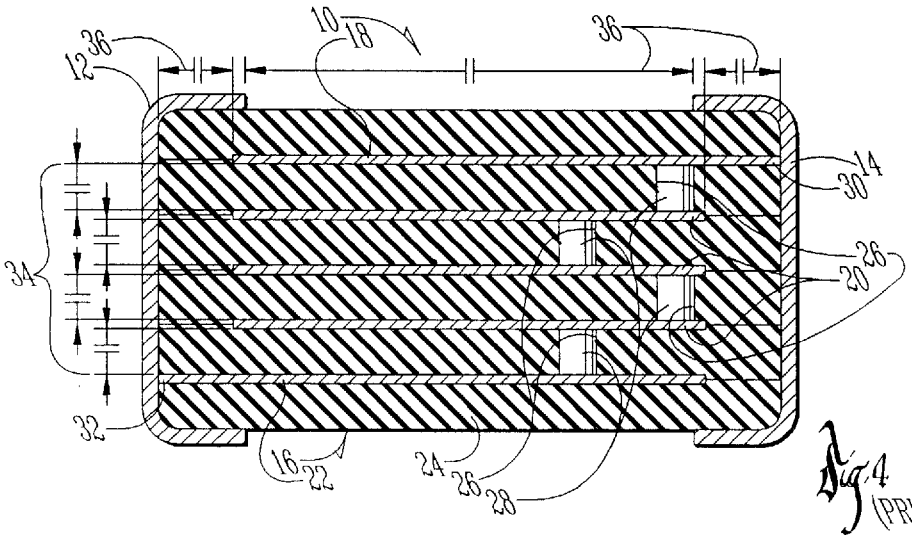
Fig. 4 (PRIOR ART)
FIG. 4 is a sectional view shown in schematic form taken along line 4—4 in FIG. 2. The distances between the various layers are enlarged from their actual proportion for illustrative purposes.
Figure 5:
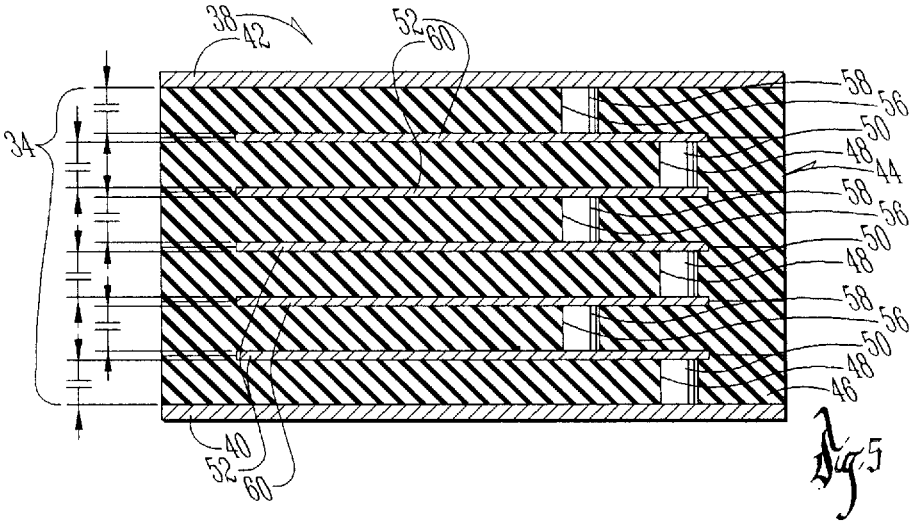
FIG. 5 is a sectional view shown schematically and taken along line 5—5 of FIG. 1.

FIGS. 4 and 5 illustrate the advantages of the present invention over the prior art. In the present invention, the terminations 40, 42 are parallel to one another, and do not extend downwardly opposite the end edges of the coil layers in the coil assembly. Consequently there are no parallel capacitances similar to the parallel capacitances 36 shown in the prior art. There continue to exist series capacitances 34 between the facing coil layers, but the elimination of the parallel capacitances 36 greatly reduces the capacitance in each inductance coil of the present invention.

Figure 7:
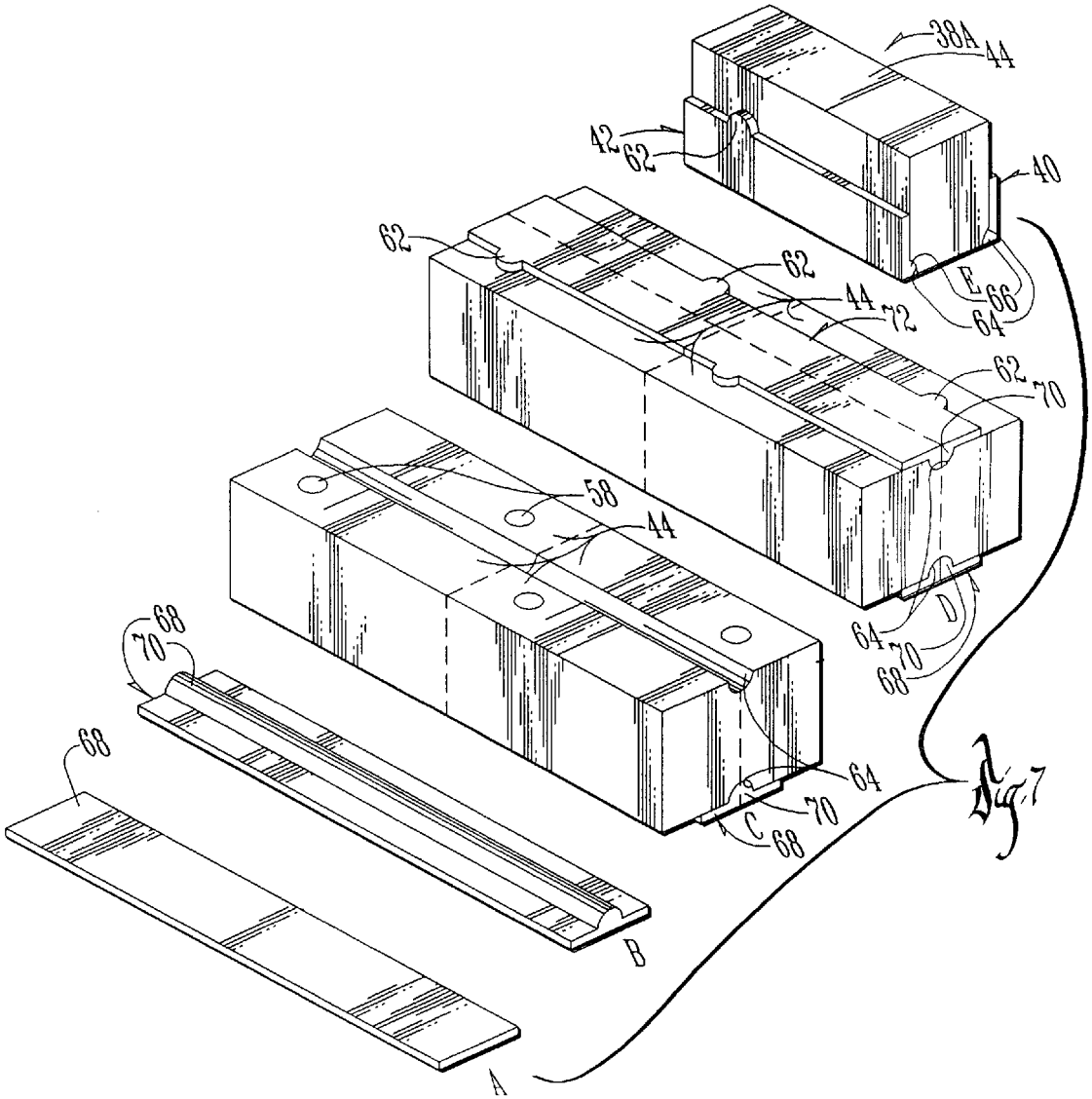
FIG. 7 is a perspective view showing various steps for creating an alternative embodiment of the inductor of the present invention.
Figure 8:
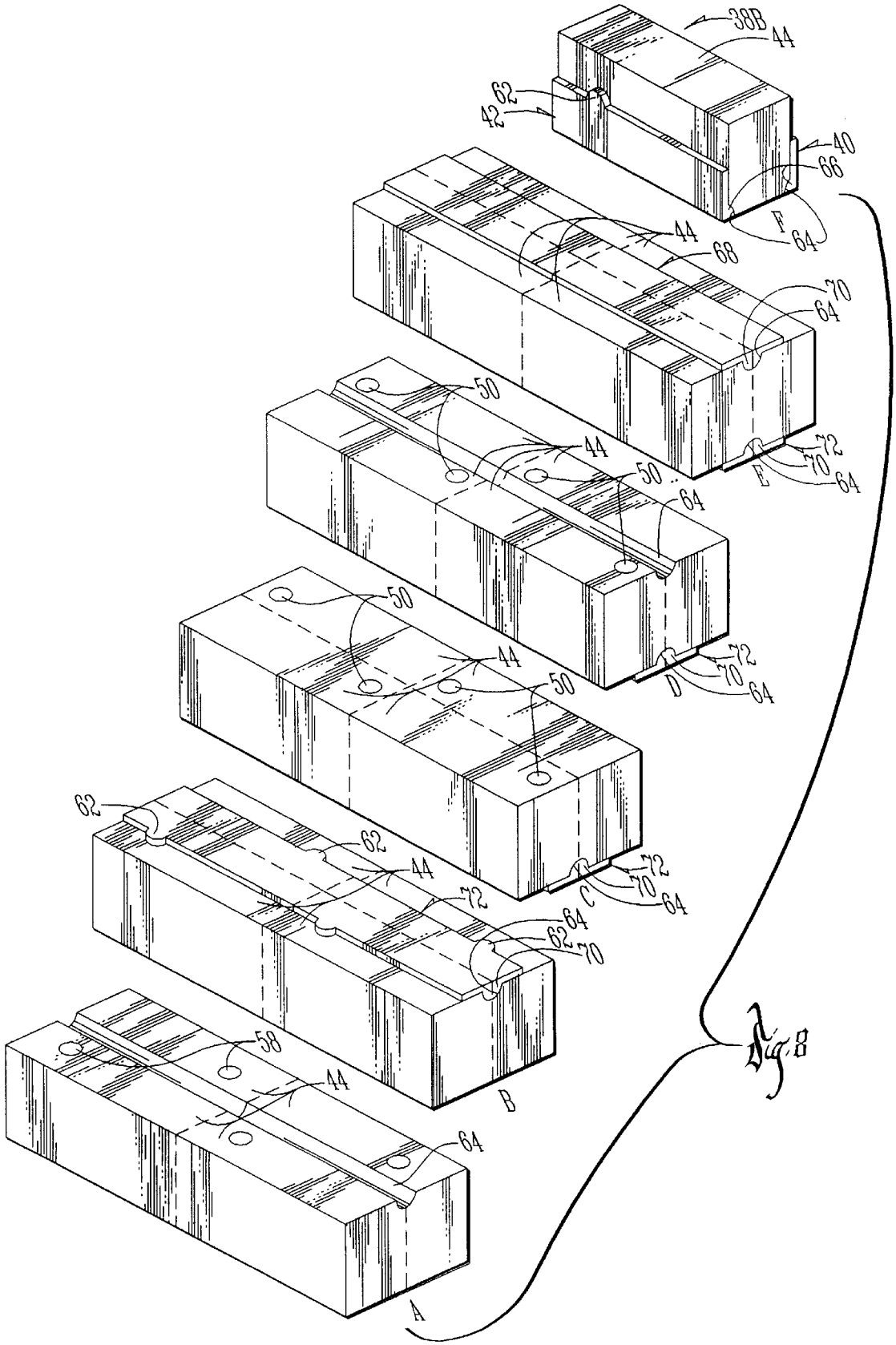
FIG. 8 is a perspective view showing various steps for creating an alternative embodiment of the inductor of the present invention.
Figure 9:
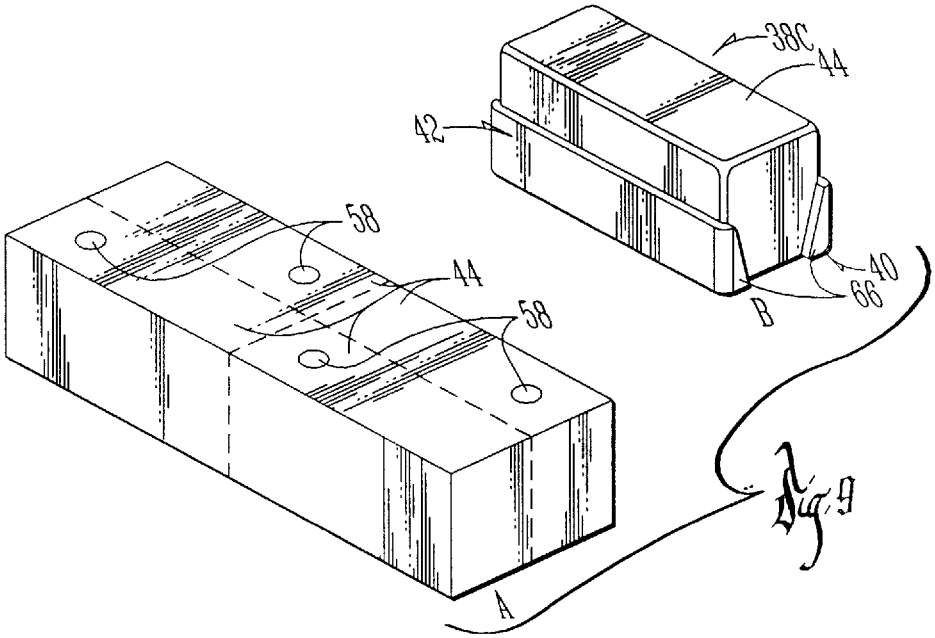
FIG. 9 is a perspective view showing various steps for creating an alternative embodiment of the inductor of the present invention.

The inductors 38 described above, have no termination silver on their mounted bottom side, i.e. the side that will contact the circuit board. In some circumstances, it is desirable to have a small amount of the termination silver on the mounted bottom side of the inductor. FIGS. 7–9 illustrate two options that can be used to apply a small amount of termination silver on the mounted bottom side of the inductor. With either option, the extra areas covered by silver must be small to avoid detrimental effects on the self resonant frequency of the inductor.

FIG. 7 shows a first option which involves forming small grooves 64 in the dielectric material during the screen printing process. The grooves 64 are formed along the position where a cut will be made to cut the individual inductors apart. In FIGS. 7–9 the cut lines are shown by dashed lines. The grooves 64 are filled with silver before the cutting step is performed. This results in a small amount of wraparound silver 66 remaining on the mounted bottom side of the inductor as shown at E in FIG. 7. The steps for performing this first option are as follows. First, a first layer of silver 68 is screen printed as shown at A in FIG. 7. This first layer of silver 68 will eventually form the first termination 40 on four separate inductors. Next, a narrow raised bump 70 of additional silver is deposited on the first layer of silver 68. The bump 70 forms an inverted groove. The bump 70 is deposited either by screen printing or other means along a cut line. The combination of these two steps are shown at B in FIG. 7. Next, the coil assembly 44 of the inductor is created using the normal screen printing steps described above. Note that FIG. 7 shows the formation of four inductors which will later be cut apart. The groove 64 on the printed topside of the parts can be formed by simply not applying dielectric ink in the area of the groove 64 during the last few prints of the "wet stack" screen printing process. This step results in the structure shown at C in FIG. 7. To form the second terminations 42, a second layer of silver 72 is screen printed over the inductor body allowing silver ink to flow into the groove 64 formed in the previous step. The resulting structure is shown at D in FIG. 7. Finally, the "wet stack" is cut into individual parts resulting in the inductor 38A shown at E in FIG. 7.

FIG. 8 shows an alternative method of forming the groove 64 on the printed bottom side of the "wet stack" described above. In this alternative method shown in FIG. 8, the groove 64 is formed by cutting it with a saw. Following are the steps needed to practice this method. First, the body of the inductor is printed using the normal screen printing steps described above. The groove 64 on the printed top side of the parts can be formed by simply not applying dielectric ink in the area of the groove 64 during the last few prints of the "wet stack" screen printing process. The resulting structure is shown at A in FIG. 8. Next, the second layer of silver 72 is screen printed, allowing silver ink to flow into the groove 64 formed in the previous step. The resulting structure is shown at B in FIG. 8. The "wet stack" is then inverted from top to bottom as shown at C in FIG. 8. Another groove 64 is then cut with a saw as shown at D in FIG. 8. Next, the first silver layer 68 is applied by screen printing or other means, while allowing silver ink to flow into and fill the grooves 64 which was previously cut with a saw. The resulting structure is shown at E in FIG. 8. Finally, the "wet stack" is cut into individual parts along the dashed lines resulting in individual inductors 38B as shown at F in FIG. 8. As shown, the terminations 40 and 42 include wraparound silver 66.

A second, but less desirable option utilizes a dipping process to apply the termination silver. Using this option, no termination silver is applied to the part using the screen printing method. Rather, the parts are dipped into termination silver at a slight angle resulting in a termination that slightly wraps around the mounted bottom side of the part. To practice this option, the parts are created using the printed process described above resulting in the "wet stack" shown at A in FIG. 9. Again note that four components are shown being simultaneously created. Next, the individual parts are cut apart along the dashed lines shown at A in FIG. 9. Each individual part is tumbled to round the corners of the component. The parts are then dipped into the termination silver at an angle to form the terminations 40 and 42 and the wraparound silver 66 as shown at B in FIG. 9.

Using either of the methods described for applying a small amount of termination silver on the mounted bottom side of the part, the amount of the printed top and printed bottom surface of the part that is covered with the termination silver is still only about half of the entire surface area of each side. This is important in order to minimize capacitance and thus maximize the self resonant frequency of the resulting inductor.

The self resonant frequency of the present invention is greatly increased over the prior art inductors because the capacitance across the coil is reduced. The self resonant frequency is inversely proportional to the capacitance of the inductor, and therefore reducing the residual capacitance increases the resonant frequency. This permits the inductor to have a higher resonant frequency and permits the inductor to be made much smaller in size than previous devices having the same resonant frequency.

Another advantage of the present invention is the elimination of the dipping process necessary to create the solder termination in the prior art devices. Furthermore the contact between the terminations 40, 42 and the coil within the inductor are far more reliable than the contact between the terminations 12, 14 of the prior art inductor and the various inductance coil layers. This is because of the direct contact provided by the via fills 58, 50 which contact the terminations 42, 40. In the prior art devices it has been necessary to grind or buff the edges of the assembled inductors before placing the terminations 12, 14 thereon. This insures the connections 30, 32 are positive and reliable. Such grinding or buffing is not necessary in the present invention.

Another advantage of the present invention is that it decreases the labor costs because of the various grinding and buffing steps which are unnecessary as well as the dipping process required to create the solder terminations 12, 14 in the prior art device.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A multilayer inductor having a high self resonant frequency resulting from a low capacitance between coil layers and terminals of the inductor comprising:

a plurality of conductor coils stacked above one another, each of said conductor coils lying substantially in a horizontal plane and being vertically spaced apart from the other of said conductor coils, one of said conductor coils being a top conductor coil positioned above all of the other of said conductor coils, and another of said conductor coils being a bottom conductor coil positioned below all of the other of said conductor coils;

a top conductive termination vertically spaced above all of said conductor coils;

a bottom conductive termination spaced below all of said conductor coils, a dielectric material extending between and separating said vertically spaced apart conductor coils and said top and bottom terminations, said dielectric material having a plurality of via holes therein which provide electrical communication between adjacent pairs of said conductive coils, between said top conductive coil and said top termination, and between said bottom conductive coil and said bottom termination;

a plurality of conductive via connections extending through said via holes to connect said plurality of conductor coils, said top termination, and said bottom termination in series with one another.

2. A multilayer inductor according to claim 1 wherein said dielectric material includes a top surface and a bottom surface, said top and bottom conductive terminations each being printed on said top and bottom surfaces respectively of said dielectric material.

3. A multilayer inductor according to claim 2 wherein a top via conductor connects said top conductor coil to said top conductive termination, and a bottom via conductor connects said bottom conductor coil to said bottom conductive termination.

4. A multilayer inductor having a high self resonant frequency resulting from a low capacitance between coil layers and terminals of the inductor comprising:

a conductor coil assembly having a plurality of coil turns connected in series with one another and including a top coil end and a bottom coil end;

a top termination electrically connected to said top boil end, all of said top termination being above all of said coil turns of said coil assembly;

a bottom termination electrically connected to said bottom coil end, all of said bottom termination being below all of said coil turns of said coil assembly;

a dielectric material extending between and at least partially separating said coil turns of said coil assembly and at least partially separating said top and bottom terminations from said coil assembly.

5. A method for making a multilayer inductor having a high self resonant frequency resulting from a low capacitance between coil layers and terminals of the inductor comprising:

forming an inductor coil comprising a first coil end and a second coil end, a plurality of conductor coil layers electrically connected in series with one another between said first and second coil ends, and a plurality of dielectric layers being alternatively interposed between said conductor coil layers;

forming a first dielectric layer over said first coil end, said first dielectric layer having a first via hole positioned in registered alignment over said first coil end;

filling said first via hole with an electrically conductive material to form a first via fill in electrical connection with said first coil end;

forming an electrically conductive first termination over said first dielectric layer in electrical contact with said first via fill so at to electrically connect said first termination to said first coil end, wherein the first termination is disposed parallel to the plurality of conductor layers;

forming a second dielectric layer over said second coil end, said second dielectric layer having a second via hole positioned in registered alignment over said second coil end;

filling said second via hole with an electrically conductive material to form a second via fill in electrical connection with said second coil end; and forming an electrically conductive second termination over the second dielectric layer in electrical contact with the second via fill so as to electrically connect said second termination to said second coil end, wherein the second termination is disposed parallel to the plurality of conductor layers.

6. A multilayer inductor having a high self resonant frequency resulting from a low capacitance between coil layers and terminals of the inductor, the multilayer inductor comprising:

a coil assembly having a plurality of conductor coils disposed parallel to each other and stacked in a spaced relation, the coil assembly have first and second ends;

a first terminal electrically connected to the first end of the coil assembly, the first terminal being formed on the coil assembly parallel to the plurality of conductor coils to reduce the capacitance between the first terminal and the plurality of conductor coils; and a second terminal electrically connected to the second end of the coil assembly, the second terminal being formed on the coil assembly parallel to the plurality of conductor coils to reduce the capacitance between the second terminal and the plurality of conductor coils.

7. The multilayer inductor of claim 6, wherein the multilayer inductor includes first and second opposing surfaces parallel to the plurality of conductor coils, and wherein the first and second terminals are disposed entirely on the first and second surfaces, respectively.

* * * * *

UNITED STATES PATENT AND TRADEMARK OFFICE

CERTIFICATE OF CORRECTION

PATENT NO. : 5,880,662
DATED : March 9, 1999
INVENTOR(S) : Person et al.

It is certified that error appears in the above-identified patent and that said Letters Patent is hereby corrected as shown below:

Column 3,
Line 33, should read -- the first termination 40. Dielectric layer 46 includes a --
Line 36, should read -- electrical contact with first termination 40 and is also in --
Line 53, should read -- dielectric layer 54 is the second termination 42 which has a tab --

Column 4,
Line 18, should read -- In either case, the second termination 42 is printed over the --

Column 7,
Line 12, should read -- a top termination electrically connected to said top coil --
Line 40, should read -- first via fill so as to electrically connect said first --

Signed and Sealed this

Fifteenth Day of March, 2005

JON W. DUDAS
*Director of the United States Patent and Trademark Office*